United States Patent [19]

Ricketts

[11] 4,281,878

[45] Aug. 4, 1981

[54] METHOD FOR LOADING EXPLOSIVE LATERALLY FROM A BOREHOLE

[75] Inventor: Thomas E. Ricketts, Grand Junction, Colo.

[73] Assignee: Occidental Oil Shale, Inc., Grand Junction, Colo.

[21] Appl. No.: 99,553

[22] Filed: Dec. 3, 1979

[51] Int. Cl.[3] ..... E21C 41/10

[52] U.S. Cl. ..... 299/2; 102/306; 299/13

[58] Field of Search ..... 299/2, 13; 175/4.5, 175/4.6; 102/23

[56] References Cited

U.S. PATENT DOCUMENTS

| | | | |
|---|---|---|---|
| 2,988,143 | 6/1961 | Scotty | 175/2 X |
| 3,011,551 | 12/1961 | Young et al. | 166/55.1 |
| 3,630,283 | 12/1971 | Knutson et al. | 166/247 |
| 3,637,020 | 1/1972 | McLamore | 102/23 X |
| 3,677,342 | 12/1969 | Silverman | 166/247 |
| 3,822,916 | 11/1972 | Jacoby | 299/4 |
| 4,018,293 | 4/1977 | Keller | 175/4.5 |
| 4,175,490 | 11/1979 | Britton et al. | 299/2 X |

OTHER PUBLICATIONS

"Blasters Handbook", Fifteenth Edition, 1969, DuPont Manual, pp. 222–225.

Bureau of Mines Report of Invest. 7397, "Evaluation of Oil-Shale Fracturing Tests Near Rock Springs, Wyo".

*Primary Examiner*—Ernest R. Purser

*Attorney, Agent, or Firm*—Christie, Parker & Hale

[57] ABSTRACT

There is provided a method for forming an in situ oil shale retort in a subterranean formation containing oil shale. At least one void is excavated in the formation, leaving zones of unfragmented formation adjacent the void. An array of main blastholes is formed in the zone of unfragmented formation and at least one explosive charge which is shaped for forming a high velocity gas jet is placed into a main blasthole with the axis of the gas jet extending transverse to the blasthole. The shaped charge is detonated for forming an auxiliary blasthole in the unfragmented formation adjacent a side wall of the main blasthole. The auxiliary blasthole extends laterally away from the main blasthole. Explosive is placed into the main blasthole and into the auxiliary blasthole and is detonated for explosively expanding formation towards the free face for forming a fragmented permeable mass of formation particles in the in situ oil shale retort.

42 Claims, 4 Drawing Figures

140
140
2
2
146a
146a
152a
152a
146a
150
146b
146b
146b
110
152b
152b
128
112
119

46a
46b
46
1
1
40a
40b
46b
46a
16
46a
46c
46a
46a
46a
10
40a
16
40a

METHOD FOR LOADING EXPLOSIVE LATERALLY FROM A BOREHOLE

BACKGROUND OF THE INVENTION

The presence of large deposits of oil shale in the Rocky Mountain region of the United States has given rise to extensive efforts to develop methods for recovering shale oil from kerogen in the oil shale deposits. It should be noted that the term "oil shale" as used in the industry is, in fact, a misnomer; it is neither shale nor does it contain oil. It is a sedimentary formation comprising marlstone deposit with layers containing an organic polymer called "kerogen" which, upon heating, decomposed to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,118,071; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retoring zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate composition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids to form a fragmented mass. Retorting of the fragmented mass is then carried out to recover shale oil from the oil shale.

U.S. Patent Application Ser. No. 929,250 titled "METHOD FOR EXPLOSIVE EXPANSION TOWARD HORIZONTAL FREE FACES FOR FORMING AN IN SITU OIL SHALE RETORT" filed July 31, 1978, by the applicant describes a method for forming an in situ oil shale retort by expanding formation toward vertically spaced apart voids. Patent Application Ser. No. 929,250 is incorporated herein by this reference.

U.S. Pat. No. 4,043,596 discloses a method of forming an in situ oil shale retort in a subterranean oil shale deposit by excavating at least one vertically extending columnar void. The surface of the formation which defines the columnar void presents at least one free face which extends vertically through the subterranean oil shale deposit. A portion of the formation within the boundary of the in situ retort to be formed and which extends away from the free face is explosively expanded toward the columnar void in one or more segments. The expansion of the oil shale toward the columnar void fragments the oil shale, thereby distributing the void volume of the columnar void throughout the retort.

It is desirable to form an in situ retort with a reasonably uniformly distributed void fraction, or a fragmented mass of reasonably uniform permeability so that gas can flow reasonably uniformly through the fragmented mass during retorting operations. Techniques used for explosively expanding zones of unfragmented formation toward the horizontal free faces of formation adjacent the voids can control the uniformity of particle size or permeability of the fragmented mass. A fragmented mass having generally uniform permeability in horizontal planes across the fragmented mass avoids bypassing portions of the fragmented mass by retorting gas as can occur if there is gas channeling through the mass owing to non-uniform permeability.

In a technique for forming an in situ oil shale retort by explosive expansion of unfragmented formation toward a free face, inefficient distribution of explosive can occur due to use of blastholes extending perpendicular to such a free face. Because the explosive is in columns perpendicular to the free face, the energy from detonation of such explosive is less effeciently utilized than if the columns of explosive were parallel to the free face.

Alternatively, when columns of explosive are provided which are parallel to a free face, the explosive may not be distributed within the formation to the extent desirable because only a limited number of blastholes are used due to the economic considerations or the like.

It is, therefore, desirable to provide a method of forming an in situ oil shale retort which provides for improved efficiency in explosively expanding formation toward a free face.

SUMMARY OF THE INVENTION

This invention relates to a method of explosively expanding a zone of unfragmented rock formation toward a free face adjacent such formation. At least one main blasthole is formed in such a zone of unfragmented rock formation. At least one explosive charge shaped for forming a high velocity gas and fragment jet is placed into such main blasthole with the axis of the gas jet extending transverse to the blasthole. Such a shaped charge is detonated to form at least one auxiliary blasthole in such a zone of unfragmented formation adjacent a side wall of the main blasthole. Such an auxiliary blasthole is in communication with the main blasthole and extends away from the main blasthole. Explosive is placed into the main blasthole and into the auxiliary blasthole and the explosive is detonated for explosively expanding the formation towards the free face.

DRAWINGS

These and other aspects of the invention will be more fully understood by referring to the following detailed description and accompanying drawings in which.

DETAILED DESCRIPTION

Figure 1:
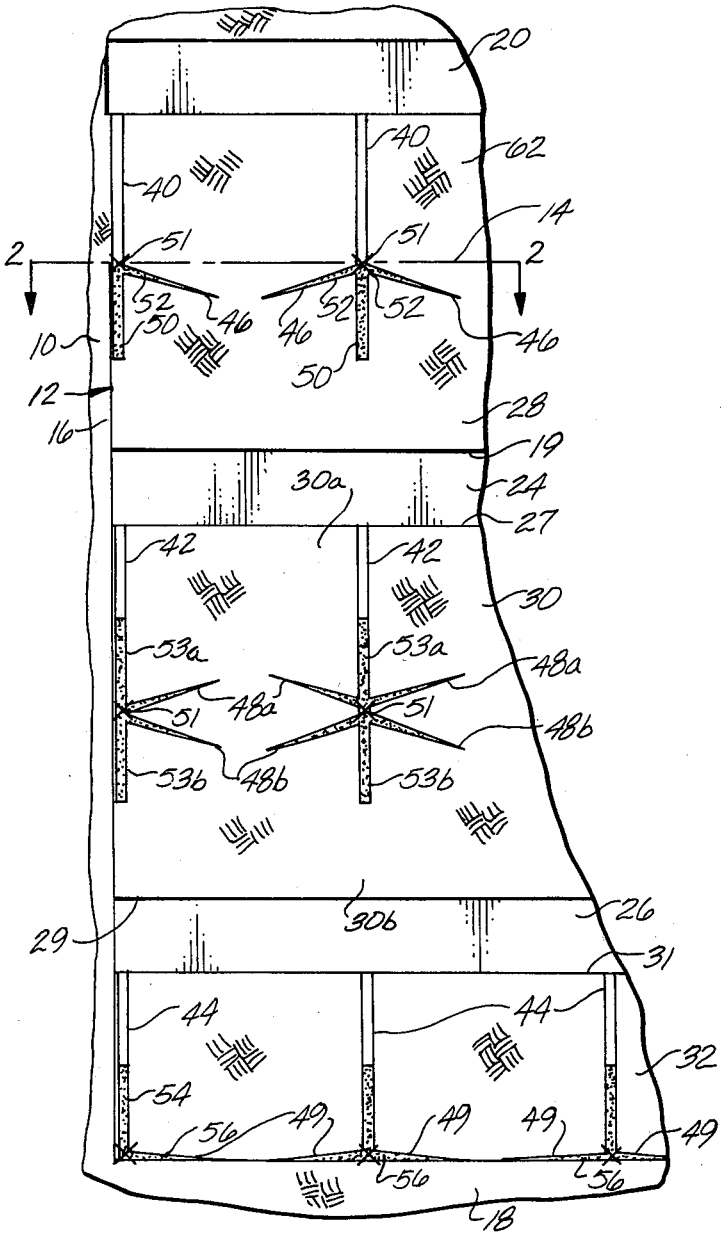
FIG. 1 is a fragmentary semi-schematic vertical cross-sectional view of a retort site at an intermediate stage during formation of an in situ oil shale retort.

This invention relates to a method of explosively expanding a zone of unfragmented rock formation toward a free face adjacent such formation to form an in situ fragmented permeable mass of formation particles within a subterranean formation. More particularly, the invention relates to a method for forming an in situ oil shale retort containing a fragmented permeable mass of formation particles containing oil shale in a retort site within such a subterranean formation. The fragmented permeable mass of formation particles has a top boundary, side boundaries, and bottom boundary of unfragmented rock formation.

In an exemplary embodiment, formation is excavated to form at least one void in the subterranean rock formation and zones of unfragmented rock formation are left adjacent the void or voids within the top boundary, side boundaries, and bottom boundary of the fragmented permeable mass of formation particles being formed.

For example, at least one generally vertical void can be formed and unfragmented rock formation can be left adjacent such a vertical void. When a vertical void or voids are used, the free face of the unfragmented rock formation adjacent the generally vertical void is a generally vertical free face. Alternatively, at least one generally horizontal void can be formed and unfragmented rock formation can be left above and/or below such a void. When a horizontal void or voids are used, the free face of the unfragmented rock formation adjacent the horizontal void is a generally horizontal free face.

The voids are not necessarily either exactly horizontal or vertical and the free faces of unfragmented formation adjoining such voids can have inclinations other than vertical or horizontal.

At least one main blasthole, and in an exemplary embodiment an array of main blastholes, can be formed in such a zone of unfragmented rock formation wherein such a main blasthole can be formed perpendicular to the free face adjacent such a void. As described hereinabove, when blastholes which are formed extend perpendicular to a free face, there is an inefficient distribution of explosive because the energy from detonation of a column of explosive extending perpendicular to a free face has been found to be less efficiently utilized than if the columns of explosive are parallel to said free face.

If desired, substantially vertical blastholes can be formed in a zone of unfragmented rock formation wherein the blastholes are perpendicular to a horizontal free face or, alternatively, the vertical blastholes can be parallel to a vertical free face. If desired, blastholes perpendicular to a vertical free face can also be used.

When blastholes are used which are parallel to a free face, e.g., vertical blastholes and a vertical free face, although the explosive is efficiently utilized, it can be desirable to use a limited number of blastholes due to economic considerations or the like. The use of a limited number of blastholes can result in less than desired distribution of explosive.

It can, therefore, be desirable to improve the distribution of explosive in unfragmented rock formation when using blastholes which are either perpendicular to a free face and/or are parallel to a free face.

In order to improve the distribution of explosive in unfragmented formation, at least one explosive charge shaped for forming a high velocity gas and fragment jet can be placed into such a main blasthole with the axis of the gas and fragment jet extending transverse to the blasthole. Although it is preferable to use shaped charges which produce both a gas jet and metal fragments from a casing or the like which encloses such a charge, shaped charges which are not encased and which only produce a gas jet can also be used.

Such a shaped charge is thereafter detonated for forming a hole in unfragmented rock formation adjacent a side wall of the main blasthole wherein such a hole is in communication with the blasthole and extends away from the main blasthole. The hole, which extends away from a "main" blasthole, can be termed an "auxiliary blasthole". An auxiliary blasthole generally has a length very much greater than its diameter. For example, auxiliary blastholes can be formed wherein the length of said auxiliary blasthole is about ten feet and the diameter is about 2 inches. Other sizes and shapes of auxiliary blastholes can be formed and used in practice of principles of this invention.

A free flowing or free running explosive such as a liquid explosive, a pelletized explosive, or pumpable slurry explosive or the like can be poured or pumped into the blasthole. The explosive flows downwardly into the main blasthole and thereafter into the auxiliary blasthole, i.e., the hole formed by the shaped charge and which is in communication with said main blasthole.

Explosive is thereafter detonated for explosively expanding unfragmented rock formation toward such a free face for forming the fragmented permeable mass of formation particles.

Figure 2:
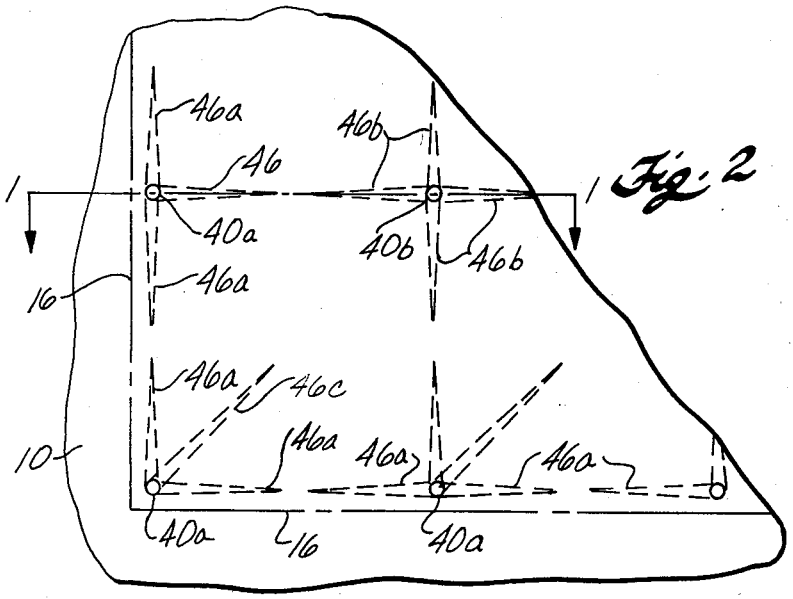
FIG. 2 is a fragmentary semi-schematic horizontal cross-sectional view taken on line 2—2 of FIG. 1.

Referring to FIGS. 1 and 2, in an exemplary embodiment of this invention, there is shown an in situ oil shale retort 12 being formed in a retort site within a subterranean rock formation 10. The subterranean rock formation of this embodiment comprises oil shale and, when formed, the in situ oil shale retort contains a fragmented permeable mass of formation particles containing oil shale.

FIG. 1 is a fragmentary, semi-schematic vertical cross-sectional view of the retort site at an intermediate stage during formation of the retort, and FIG. 2 is a fragmentary, semi-schematic horizontal cross-sectional view taken on line 2—2 of FIG. 1.

In the exemplary embodiment shown in FIG. 1, the retort being formed has a substantially horizontal top boundary 14, four generally vertically extending side boundaries 16, and a bottom boundary 18 of unfragmented formation. Formation is excavated to form an upper level base of operation 20 above the top boundary 14. The upper level base of operation has a sufficient horizontal cross-section for providing effective access over substantially the entire horizontal cross-section of a fragmented permeable mass of formation particles being formed. A first portion of formation is excavated to form at least one substantially horizontal void within the boundaries of the retort being formed, and a remaining portion of formation is left within the boundaries adjacent such a void or voids. In the exemplary embodiment, formation is excavated to form a substantially horizontal upper void 24 and a substantially horizontal lower void 26. The upper void and lower void can occupy between about 15% and about 35% of the total volume of formation within the boundaries of the retort being formed. Although, in the exemplary embodiment shown, there are no pillars of unfragmented formation left within the voids, one or more pillars can be left within each void, such pillars extending between the roof and floor of such a void for providing temporary support for overlying formation.

The remaining portion of unfragmented formation left within the boundaries of the retort being formed in the exemplary embodiment comprises an upper zone 28 of unfragmented formation adjacent and above the upper void 24, an intermediate zone 30 of unfragmented formation, and a lower zone 32 of unfragmented formation. The intermediate zone of unfragmented formation extends vertically between the upper void 24 and the lower void 26. The intermediate zone of unfragmented formation has a substantially horizontal upper free face 27 adjacent and below the upper void and a substantially horizontal lower free face 29 adjacent and above the lower void. The lower zone 32 of unfragmented formation extends between the bottom boundary 18 of the retort being formed and the lower void 26. The lower zone of unfragmented formation has a substantially horizontal upper free face 31 which is adjacent and below the lower void. The upper zone of unfragmented formation has a substantially horizontal free face 19 and extends between the upper void 24 and the top boundary 14 of unfragmented formation.

The remaining portion of unfragmented formation, i.e., the zones of unfragmented formation above and/or below the voids, is prepared for explosive expansion by forming an array of vertically extending main columnar explosive charges in such unfragmented formation. Such a vertically extending columnar explosive charge is generally perpendicular to the substantially horizontal free face towards which unfragmented formation is to be explosively expanded. Additionally, a laterally extending columnar explosive charge is formed in communication with such a vertically extending columnar explosive charge.

When explosively expanding unfragmented formation toward a free face, it is desired to obtain mixing and rotation of the particles formed. Having mixing and rotation of the particles formed enhances formation of a fragmented permeable mass of formation particles having a uniformly distributed void fraction and uniform permeability. The achievement of desired mixing and rotation of formation particles can be enhanced by providing laterally extending columnar explosive charges for enhancing the distribution of explosive in the zone of unfragmented formation. It is desired that the explosive which is distributed act on substantially the entire zone of unfragmented formation to be explosively expanded toward a free face. Therefore, at least a portion of such laterally extending columnar explosive charges is formed at a location most remote from the free face toward which such unfragmented formation is to be explosively expanded.

In the exemplary embodiment, explosive charges are formed by drilling an array of substantially vertical main blastholes into the upper, intermediate, and lower zones of the remaining portion of unfragmented formation. For example, an array of spaced apart main blastholes 40 is drilled into the upper zone 28 of unfragmented formation from the upper level base of operation 20. An array of spaced apart main blastholes 42 is drilled into the intermediate zone 30 of unfragmented formation from the upper void 24 and an array of spaced apart main blastholes 44 is drilled into the lower zone 32 of unfragmented formation from the lower void 26. The blastholes are shown out of proportion in the figures for clarity of illustration, i.e., the blasthole diameter is actually much smaller in comparison to the size of the retort being formed than shown in the figures.

Blasthole arrays used in practice of principles of this invention can be formed of any number of blastholes having various configurations. For example, it can be desirable to use a square array of blastholes. In a square array of blastholes, a quadrilateral defined by each four adjacent blastholes has sides which are equal. Alternatively, it can be desirable to use a rectangular array of blastholes. In a rectangular array of blastholes, the quadrilateral defined by each four adjacent blastholes has sides which are not equal. Triangular or other arrays of blastholes can also be used.

In the exemplary embodiment, the arrays of spaced apart blastholes formed in each of the upper, intermediate, and lower zones of unfragmented formation comprise arrays of blastholes having nine rows of blastholes with nine blastholes in each row. The arrays of spaced apart blastholes are square arrays having equal spacing distance between adjacent blastholes.

In addition to the main blastholes formed, one or more lateral holes, i.e., auxiliary blastholes, are formed in the unfragmented formation adjacent a side wall of each of a plurality of the substantially vertical main blastholes. Each such lateral hole formed is in communication with, and extends laterally from, such a substantially vertical main blasthole. In the exemplary embodiment, lateral holes, i.e., auxiliary blastholes 46, extend laterally from the blasthole 40 in the upper zone 28 of unfragmented formation, auxiliary blastholes 48 extend laterally from the blastholes 42 in the intermediate zone 30 of unfragmented formation, and auxiliary blastholes 49 extend laterally from the blastholes 44 in the lower zone 32 of unfragmented formation.

The laterally extending holes can be formed in unfragmented formation by placement of an explosive charge, shaped for forming a high velocity gas jet into a blasthole, as described hereinabove. The shaped charge can be mounted on a rod or tube and directed so that the axis of the gas jet extends transverse to the blasthole.

A shaped charge is a compact charge of explosive shaped to have a generally conical concave opening on one side. When such an explosive charge is detonated, the concave surface tends to concentrate the explosive force and a jet of hot gas and fragments which are generated is directed out of the cavity. It has been found that such jets of hot gas and fragments can pierce rock to form a hole having a length very much longer than its diameter. Such a hole can be formed by crushing and compressing adjacent rock and by ejecting material from the hole so formed. The length to diameter ratio obtainable depends on the geometry of the shaped charge and the properties of the rock. Holes with a length very much greater than diameter are feasible with available shaped charges. For example, a shaped charge is now available which will fit into a six-inch diameter borehole for directing a gas jet laterally relative to the axis of the borehole. Such a shaped charge can make a two-inch hole through the side wall of the borehole up to about 10 feet into adjacent unfragmented formation. It is estimated that with a 12-inch borehole, laterally extending holes about 4 inches in diameter and about 20 feet long can be made with shaped charges.

In the exemplary embodiment, shaped charges are placed into each of the main blastholes 40 and directed so that the gas and fragment jets impinge on the side wall of such blastholes in the directions desired for forming the laterally extending holes. The shaped charges are thereafter detonated for forming the laterally extending holes 46 in unfragmented formation adjacent a side wall of such blastholes 40.

A free flowing or free running explosive such as a liquid, free running pellets, or a pumpable slurry explosive can be introduced into each main blasthole formed for providing a columnar main explosive charge. As the liquid or free running solid fills the blastholes, it can flow or be pumped into the laterally extending holes to form laterally extending columnar explosive charges. Thus, the laterally extending auxiliary columnar explosive charges formed are in communication with such main columnar explosive charges formed in the main blasthole.

In the exemplary embodiment, for example, a free flowing or free running explosive is introduced into each main blasthole 40 for providing a vertically extending columnar main explosive charge 50 which is generally perpendicular to the substantially horizontal free face 19. The array of vertically extending columnar explosive charges 50 formed in the blastholes 40 is parallel to the free face 19. As the explosive fills the main blastholes 40, it flows into the laterally extending auxiliary blastholes 46 to form laterally extending columnar explosive charges 52. The laterally extending columnar explosive charges 52 are in communication with such vertically extending main columnar explosive charges 50.

It can be desirable to form the vertically extending columnar explosive charges, i.e., the main charges, so that the column length of each main explosive charge is about one-half the thickness of the unfragmented formation to be explosively expanded. This has been found to be about the most efficient configuration of explosive charges in terms of the amount of explosive used in relation to the amount of rotation and mixing of oil shale particles obtained.

When explosively expanding formation in layers toward a void, however, it has been found that the layers which are first explosively expanded toward the void can have a very high level of bulking, i.e., the layers have a high void fraction. This high bulking of formation from the first layers of formation expanded toward a void can be undesirable because subsequent layers of formation expanded toward the void do not have the desired volume into which to expand. Formation from these subsequent layers, therefore, has less bulking and a low void fraction. This can, therefore, cause uneven distribution of a void fraction in a fragmented permeable mass of formation particles formed in an in situ oil shale retort.

In another embodiment used in practice of principles of this invention, it can be desirable to use a small amount of explosive in the main blasthole to form the main explosive charge while distributing a substantial amount of explosive in the laterally extending holes, as described hereinabove.

This embodiment can be used, for example, to explosively expand a first layer of unfragmented formation toward a void to achieve less bulking, rotation, and a mixing of fragmented oil shale particles than would be obtained if main explosive charges were formed having a columnar length about half the width of the unfragmented formation. This embodiment provides a lower powder factor for explosively expanding the layers of unfragmented formation nearest the void to achieve the desired limited bulking for these first layers.

In accordance with this invention, it is desired that the hole formed by the shaped charge extend laterally from the main blasthole at an acute angle with the direction of propagation of a detonation wave from the detonation of explosive in such a main blasthole when explosively expanding formation. This helps assure that explosive in the lateral hole is also detonated.

Referring again to FIG. 1, for example, detonators 51 designated by an "x" indicate the point of initiation of detonation of explosive in each of the vertical blastholes 40. The propagation of a detonation wave from the detonation of explosive in the blasthole 40 is, therefore, downwardly from at about the top boundary 14 toward the free face 29. It is, therefore, desirable to have the laterally extending blastholes 46 through the side wall of the blasthole 40 extend downwardly. It has been found that propagation of a detonation wave is enhanced when it is not required to propagate around sharp corners and the like. Therefore, having the axis of the laterally extending columnar explosive charge at an acute angle, i.e., an angle of less than about 90° with the axis of the blasthole 40 in the direction away from the means for detonating the explosive in the blasthole 40, enhances propagation of the detonation wave. When the angle between the direction of propagation of the detonation of explosive and the axis of a laterally extending blasthole is about 90°, a booster can be placed at the juncture of the vertical blasthole and the laterally extending hole, i.e., the "base" of the laterally extending explosive charge, if desired, to insure detonation of explosive in the lateral hole. The "base" of the laterally extending explosive charges is referred to herein as the location in the charge where the auxiliary charge is in communication with the explosive in the vertically extending blasthole. Having a booster located at about the base or opening of the laterally extending hole provides additional energy at that point for initiating detonation of explosive in such laterally extending holes. A booster is a high energy explosive charge which can direct a detonation wave into such a lateral hole.

When unfragmented formation is explosively expanded toward a vertical free face using vertical blastholes, the laterally extending holes are generally formed parallel to such a free face in a downward direction. Having the lateral holes formed in a downward direction enhances the filling of such holes with explosive. Additionally, the explosive in the vertical blasthole can be detonated above the opening of the laterally extending hole to enhance detonation of the explosive in said laterally extending hole.

One or more laterally extending holes can be formed in communication with all or a portion of the blastholes in a blasthole array. The radial direction of the axes of such laterally extending holes can be chosen so as to generally enhance the distribution of explosive in the unfragmented formation to be explosively expanded and/or to specifically place explosive in unfragmented formation at a location where additional explosive is desired.

For example, it has been found that it takes a substantial amount of explosive to explosively expand formation from at about the side boundaries of a retort being formed for providing desired mixing and fragmentation of formation particles for providing a substantially uniform void fraction across the entire horizontal cross-section of the retort being formed. When large amounts of explosive are used to provide desired interaction between formation particles, the boundaries of the retort being formed, i.e., side walls of the retort formed, may not be smooth. This indicates that the unfragmented formation, i.e., barriers, between a side boundary of one retort in a formation and the side boundary of a second adjacent retort can be damaged.

It can, therefore, be desirable to form laterally extending holes along the edges of a retort to enhance formation of a retort having smooth sides. This technique can be desirable when blasting toward free faces which are vertical, horizontal, or inclined at other angles. These laterally extending holes can be in communication with the vertical blasthole adjacent a side boundary of a retort wherein such a laterally extending hole extends in a direction parallel to such a side boundary.

When laterally extending holes are formed communicating with vertically extending blastholes adjacent side boundaries of the retort being formed, fewer blastholes which have smaller diameters can be used and the distribution of explosive is enhanced. With improved distribution of explosive, less explosive is needed to provide the proper interaction and mixing and rotation of formation particles adjacent side boundaries or walls of the retort. Therefore, using laterally extending blastholes can reduce seismic effects in the round of explosive expansions, reduce the amount of explosive used in blastholes adjacent side walls, reduce the probability of damaging unfragmented formation between such adjacent retorts outside the boundaries of the retort being formed, and form a retort having smoother side walls.

Referring now to FIG. 2, for example, vertical blastholes designated 40*a* are adjacent a side boundary 16 of the retort 12 being formed in subterranean formation 10. The laterally extending holes designated 46*a* extend from the blastholes 40*a* and are parallel to such side boundaries of the retort being formed.

In addition to the laterally extending holes designated 46*a* which extend parallel to the edge of the retort being formed, it can be desirable to form any number of additional holes extending laterally from such a vertical blasthole.

In an exemplary embodiment, the vertical blasthole designated 40*b* is shown having four holes designated 46*b* laterally extending therefrom at different radial angles. Having four laterally extending explosive charges formed in the holes 46*b* enhances the distribution of explosive in the unfragmented formation. Such lateral holes can extend diagonally in the square array of blastholes as indicated by the lateral hole 46*c* in FIG. 2.

Referring again to FIG. 1, detonators designated by an "x" are shown located in the blasthole 40 at about the top boundary 14 of the retort being formed. The explosive charge 50 in the blasthole 40 is detonated at about the top boundary and the propagation of detonation is downwardly toward the free face 19. The laterally extending holes 46 are desirably formed at about the location of initiation of detonation of explosive in the vertical blasthole 40 so tht detonation is essentially directly from the initiator and it is not necessary for a detonation wave to propagate around a sharp corner. The laterally extending hole is preferably at the location most remote from the free face 19, enabling the explosive charge 52 formed in such a laterally extending auxiliary blasthole 46 to act on formation located between the upper boundary 14 of the retort being formed and the free face toward which the unfragmented formation is to be explosively expanded.

For purposes of exposition herein, the main explosive charge 50 and auxiliary explosive charge 52 are considered as a "combined explosive charge". The actual depth of burial of such a "combined explosive charge" is greater than the actual depth of burial of the main explosive charge taken by itself. The actual depth of burial of an explosive charge is the distance from the free face towards which formation is to be expanded to the center of mass of such a charge.

Having a greater depth of burial of the "combined explosive charge" as compared to the depth of burial of the main explosive charge improves expansion of formation located at about the point of initiation of detonation of explosive in the blasthole 40. Since the location of initiation of detonation is at the base of the charge in the vertical blasthole, the smoothness of the upper boundary 14 is enhanced, by using such a "combined explosive charge" as compared to using only a main explosive charge.

Having the upper boundary of the retort being formed having enhanced smoothness improves the stability of the upper boundary of such a retort.

The intermediate zone of unfragmented formation 30 is prepared for explosive expansion by drilling an array of substantially vertical blastholes 42 into such a zone of unfragmented formation. Additionally, laterally extending holes 48 are formed in the intermediate zone of unfragmented formation in a similar manner as the formation of the laterally extending holes formed in the upper zone 28 of unfragmented formation.

The intermediate zone of unfragmented formation 30 has an upper portion designated 30*a* which is to be explosively expanded upwardly toward the upper void 24 and a lower portion designated 30*b* which is to be expanded downwardly toward the lower void 26. Explosive is placed into the blastholes 42 for forming explosive charges 53 which are detonated at about their center. The detonators 51 placed into the explosive charges 53 are designated by an "x". The detonation wave, therefore, proceeds upwardly in the upper portion of the explosive charge 53 which is designated 53*a* and downwardly in the lower portion of the explosive charge 53 which is designated 53*b*.

It can be desirable to provide laterally extending explosive charges for providing enhanced distribution of explosive for explosively expanding the upper portion of unfragmented formation toward the upper void and for explosively expanding the lower portion of formation toward the lower void. This can be accomplished, for example, by providing one or more laterally extending explosive charges from such a vertical blasthole.

It can, for example, be desirable to form one or a plurality of laterally extending explosive charges from a vertical blasthole extending at an angle of about 90° from such a blasthole. In the exemplary embodiment, when explosively expanding a zone of unfragmented formation such as the intermediate zone 30, the laterally extending holes can extend from at about the center of mass of such a vertical explosive charge. The forces from detonation of explosive in such laterally extending holes are, therefore, directed equally toward both free faces toward which the intermediate zone is being explosively expanded.

Alternatively, it can be desirable to provide at least one laterally extending hole to enhance the distribution of forces from detonation of explosive toward each free face. For example, the explosive charges designated 53*a* are detonated at the detonator designated by an "x" and detonation travels upwardly in the explosive charge 53*a* toward the free face 27. At least one laterally extending hole designated 48*a* is, therefore, provided at about the location of the detonator, wherein the hole 48*a* has an axis in the direction of propagation of the detonation of the explosive charge 53*a* in such a vertical blasthole. The detonation of the vertical explosive charge 53*b* is initiated at the detonator designated by an "x" and travels downwardly toward the free face 29. At least one laterally extending hole designated 48*b* is formed with its base at about the location of the detonator, preferably having an axis tilted in the direction of the propagation of the detonation wave formed by detonating the explosive charge 53*b*. For purposes of illustration, the lateral hole 48*a* is shown above the detonator and the lateral hole 48*b* is shown below the detonator. It can be understood that if the blastholes are formed having different radial angles from the vertical blasthole 42, the opening of a plurality of lateral holes such as those designated 48*a* and 48*b* can all be at about the location of the detonator.

When forming the explosive charge in the vertically extending blasthole 42, and in the lateral holes designated 48*a* and 48*b*, a free flowing explosive can be poured or pumped into the blasthole 42. The explosive flows into the blasthole 42 and downwardly into the laterally extending hole 48*b* and also into the laterally extending hole 48*a*. There can be a means provided, if desired, for venting the laterally extending hole 48*a* for allowing air to escape, thereby allowing for the filling of the blasthole 48*a* with liquid explosive. Venting can occur through permeable portions of the formation.

In the exemplary embodiment, the lower zone 32 of unfragmented formation is prepared for explosive expansion by drilling an array of substantially vertical blastholes 44 therein. Laterally extending holes 49 are formed in a similar manner as the laterally extending holes 48*a* and 48*b* in the intermediate zone of unfragmented formation and the laterally extending holes 46 in the upper zone of unfragmented formation. The blastholes 44 in the lower zone of unfragmented formation are loaded with free flowing explosive for forming the explosive charges 54 in the substantially vertical blasthole 44 and explosive charges 56 in the laterally extending holes 49.

If desired, one or more laterally extending holes can be formed along the length of a blasthole in addition to the laterally extending holes formed at the location most remote from the free face. Using laterally extending holes along the length of such a blasthole provides additional mixing and rotation of particles in layers of unfragmented formation closer to the free face.

Figure 3:
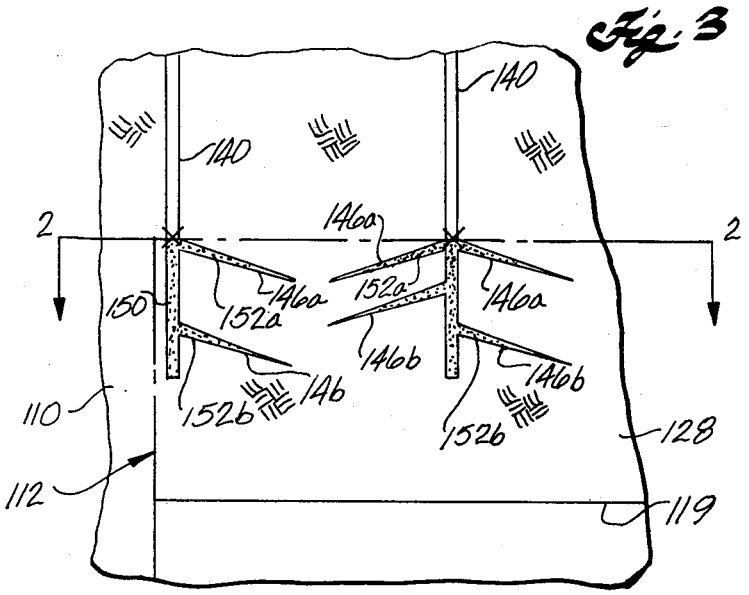
FIG. 3 is a fragmentary semi-schematic vertical cross-sectional view showing a portion of subterranean formation containing oil shale prepared by use of another embodiment of the present invention for explosive expansion for forming an in situ oil shale retort.

For example, referring to FIG. 3, a semi-schematic vertical cross-sectional view of a retort similar to the retort being formed by FIG. 1 is shown. The retort 112 is being formed in a subterranean formation 110 having blastholes 140 drilled into a zone of unfragmented formation 128. Laterally extending holes 146 are formed in communication with the blastholes 140. The laterally extending holes designated 146*a* are formed at a location of initiation of detonation of explosive charge 150 which has been placed into the blasthole 140. Additionally, laterally extending holes designated 146*b* are shown in communication with the blastholes 140 and extending laterally therefrom. The blastholes 146*b* are closer to the free face 119 than are the laterally extending holes 146*a*. Also, the laterally extending blastholes 146*b* can be formed so as to extend laterally in the same or a different radial direction than the direction of such a laterally extending blasthole 146*a*. When a laterally extending blasthole 146*b* extends in a different radial direction than the blasthole 146, distribution of explosive in the formation is further enhanced.

Explosive is placed into the blastholes 140 for providing the explosive charges 150, the explosive flows into the laterally extending holes designated 146*a* for providing explosive charges 152*a*, and the explosive flows into the laterally extending holes 146*b* for providing explosive charges 152*b*.

In the exemplary embodiment shown in FIG. 3, therefore, there is additional explosive distributed, both vertically and horizontally in the layer of unfragmented formation to be explosively expanded.

It can be desired, in order to insure proper detonation of explosive charges in laterally extending holes such as the laterally extending holes 146*a* and 146*b*, to provide boosters at about the base of the laterally extending explosive charges. Providing boosters at the base of the laterally extending explosive charges can be particularly desired when the angle between the axis of the laterally extending charge and the direction of propagation of detonation of explosive in the vertical blasthole approaches 90° or more.

Referring again to FIG. 1, the blastholes are stemmed in a conventional maner. Explosive in the blastholes is detonated for explosively expanding formation toward the horizontal free faces for forming the fragmented permeable mass of formation particles in an in situ oil shale retort. It is preferred that the explosive is detonated in a single round in order to enhance uniform vertical void fraction distribution, to minimize mounding, and to preclude large openings from remaining unsupported for long periods of time which can result in uncontrolled caving of formation.

The lower zone 32 of unfragmented formation is explosively expanded upwardly toward the free face 31, the upper zone 28 of unfragmented formation is explosively expanded downwardly toward the free face 19. An upper portion of the intermediate zone of unfragmented formation is explosively expanded upwardly toward the free face 27 and a lower portion of the intermediate zone of unfragmented formation is explosively expanded downwardly toward the free face 29.

When forming an in situ oil shale retort having generally horizontally extending voids, it is sometimes desirable to leave one or more pillars of unfragmented formation within a void for temporary support of overlying formation, as described hereinabove. Presence of such a pillar can inhibit access of drilling equipment near the pillar, making it difficult to drill blastholes in all portions of the retort site. It can be desirable to have explosive location in a zone of unfragmented formation adjacent such a pillar. Thus, when forming a fragmented permeable mass of particles in a retort, explosive can be first detonated in such a pillar for explosively expanding the pillar, forming a free face at the juncture of the pillar and the adjacent unfragmented formation. Thereafter, explosive is detonated in the adjacent zone of unfragmented formation for explosively expanding that zone. Uniform explosive expansion is enhanced by locating explosive in the portion of the zone adjacent such a pillar.

A technique as hereinabove described can be employed in such an embodiment by drilling a vertical blasthole beside the pillar, forming a hole extending laterally under and/or above the pillar through unfragmented formation adjacent the blasthole and loading such laterally extending holes with explosive. A plurality of such laterally extending holes extending from one or more vertical blastholes can provide an adequate amount of explosive for explosively expanding formation adjacent such a pillar.

Figure 4:
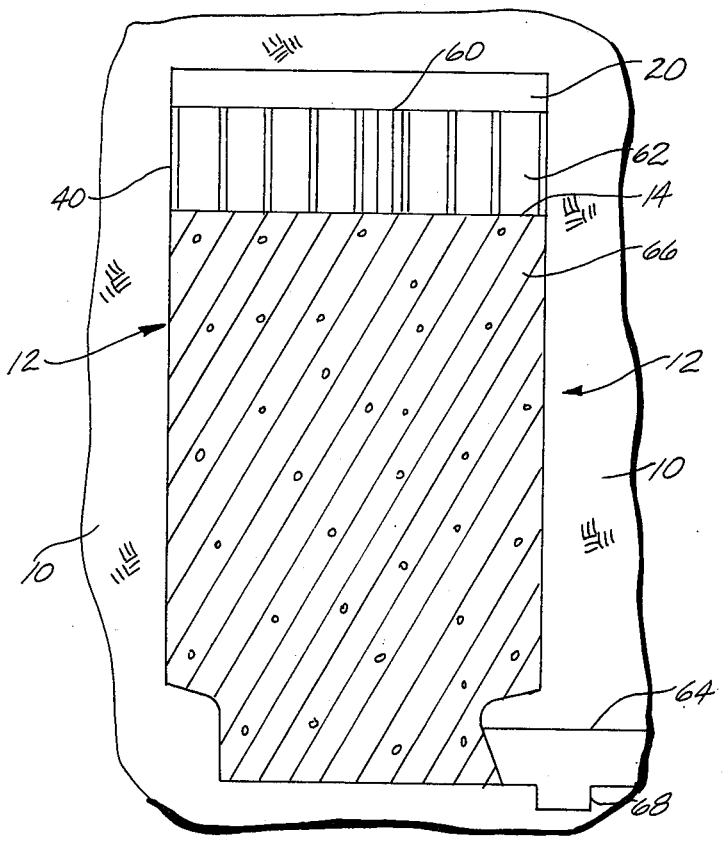
FIG. 4 is a semi-schematic vertical cross-sectional view of an in situ oil shale retort prepared according to this invention.

After having formed a fragmented permeable mass of oil shale particles in an in situ oil shale retort 12, as illustrated in FIG. 4, the final preparation steps for producing liquid and gaseous products in the retort are carried out. These steps include drilling at least one gas feed passageway 60 downwardly from the base of operation 20 to the top boundary 14 of unfragmented formation so that oxygen-supplying gas can be introduced into the fragmented mass during the retorting operations.

Alternatively, at least a portion of the blastholes 40 through a sill pillar of unfragmented formation 62 can be used for introduction of the oxygen-supplying gas. The sill pillar of unfragmented formation provides a barrier between the top boundary 14 of the retort and the base of operation 20 during retorting operations, thereby preventing gases or heat from escaping from the retort into the base of operation 20. Alternatively, referring to FIG. 1, the sill pillar of unfragmented formation 62 is also explosively expanded and the upper boundary of the retort is adjacent the top of the air level void 20. In such an embodiment, a retort inlet mixture is introduced from an overlying or laterally adjacent drift or from above ground.

In the embodiment hereinabove described and illustrated in FIGS. 1 and 2, an adjacent zone or zones of unfragmented formation are explosively expanded upwardly and downwardly towards an adjacent void. It will be appreciated that a zone of formation above such a void can be explosively expanded downwardly into such a void leaving formation beneath the void unfragmented or, if desired, a zone of formation can be explosively expanded upwardly toward an overlying void leaving formation above the void unfragmented. Thus, for example, in the embodiment illustrated in FIG. 1, the sill pillar 62 can be explosively expanded toward the overlying base of operation 20.

A substantially horizontal product withdrawal drift 64 extends away from the lower portion of the fragmented mass at a lower or production level. The product withdrawal drift 64 is used for removal of liquid and gaseous products of retorting.

During retorting operations, a combustion zone is established in the fragmented permeable mass of formation particles 66 and the combustion zone is advanced downwardly through such a fragmented mass by introduction of oxygen-supplying gas into the retort. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off gas containing gaseous products passes to the bottom of the fragmented mass and are withdrawn from the product withdrawal drift. A pump (not shown) is used to withdraw liquid products from a sump 68 to above ground. Off gas is withdrawn by a blower (not shown) and passed to above ground.

The above description of a method for recovering oil shale from a subterranean formation containing oil shale including the description of preparing the zones of unfragmented formation for explosive expansion is for illustrative purposes. Because of variations which will be apparent to those skilled in the art, the present invention is not intended to be limited to the particular embodiments described above. The scope of the invention is defined in the following claims.

What is claimed is:

1. A method of explosively expanding a zone of unfragmented rock formation toward a free face adjacent such formation comprising the steps of:

(a) forming at least one main blasthole in such a zone of unfragmented rock formation;

(b) placing at least one explosive charge shaped for forming a high velocity gas jet into such main blasthole with the axis of the high velocity gas jet extending transverse to the blasthole;

(c) detonating such a shaped charge to form at least one auxiliary blasthole in such a zone of unfragmented formation adjacent a side wall of the main blasthole, wherein such an auxiliary blasthole is in communication with the main blasthole and extends away from the main blasthole;

(d) placing explosive into the main blasthole and the auxiliary blasthole; and (e) detonating the explosive for explosively expanding the zone of unfragmented rock formation toward the free face.

2. The method according to claim 1 comprising forming such a main blasthole in such a zone of unfragmented rock formation, wherein the main blasthole is perpendicular to such a free face.

3. The method according to claim 1 comprising forming such an auxiliary blasthole, wherein the axis of the auxiliary blasthole is at an acute angle with the direction of propagation of a detonation wave in such a main blasthole.

4. The method according to claim 1 wherein the explosive placed into the main blasthole and into the auxiliary blasthole comprises a free-running explosive.

5. The method according to claim 1 comprising forming such an auxiliary blasthole, wherein the length of the auxiliary blasthole is very much greater than the diameter of such an auxiliary blasthole.

6. The method according to claim 1 wherein such a shaped charge forms a high velocity gas and fragment jet.

7. The method according to claim 1 comprising forming such an auxiliary blasthole at about the location of initiation of detonation of explosive in such a main blasthole.

8. The method according to claim 1 comprising forming a plurality of auxiliary blastholes extending from such a main blasthole, wherein such auxiliary blastholes are formed at a plurality of locations and radial directions along the length of the main blasthole.

9. The method according to claim 1 comprising the additional step of placing a booster at the opening of such an auxiliary blasthole.

10. A method of forming an in situ fragmented permeable mass of formation particles within a subterranean formation, the in situ fragmented permeable mass of formation particles having a top boundary, side boundaries, and a bottom boundary of unfragmented formation, the method comprising the steps of:

(a) excavating formation to form at least one void in the subterranean formation, leaving zones of unfragmented formation adjacent such a void, within the top boundary, side boundaries, and bottom boundary of the fragmented permeable mass being formed, such a zone of unfragmented formation having a free face adjacent the void;

(b) forming at least one main blasthole in such a zone of unfragmented formation;

(c) placing at least one explosive charge shaped for forming a high velocity gas and fragment jet into such a main blasthole with the axis of the high velocity gas and fragment jet extending transverse to the main blasthole;

(d) detonating such a shaped charge for forming an auxiliary blasthole in unfragmented formation adjacent a side wall of the main blasthole, wherein such an auxiliary blasthole is in communication with the main blasthole and extends away from the main blasthole;

(e) placing explosive into the main blasthole and into such an auxiliary blasthole; and (f) detonating the explosive for explosively expanding formation toward such a free face for forming the in situ fragmented permeable mass of formation particles.

11. The method according to claim 10 comprising forming such an auxiliary blasthole, wherein the axis of such an auxiliary blasthole is at an acute angle with the direction of propagation of a detonation wave in such a main blasthole.

12. The method according to claim 10 comprising forming at least one auxiliary blasthole in communication with such a main blasthole located adjacent a side boundary of the fragmented permeable mass of formation particles being formed, wherein the auxiliary blasthole extends in a direction parallel to such a side boundary.

13. The method according to claim 10 comprising leaving a zone of unfragmented formation above and below such a void, such a zone of unfragmented formation having a substantially horizontal free face adjoining the void.

14. The method according to claim 10 comprising forming such an auxiliary blasthole, wherein the length of the auxiliary blasthole is very much greater than the diameter of such an auxiliary blasthole.

15. The method according to claim 10 comprising forming such an auxiliary blasthole at about the location of initiation of detonation of explosive in such a main blasthole.

16. The method according to claim 10 comprising forming a plurality of auxiliary blastholes from such a main blasthole, wherein such auxiliary blastholes are formed at a plurality of locations and radial directions along the length of the main blasthole.

17. The method according to claim 10 comprising the step of placing a booster at the opening of such an auxiliary blasthole.

18. A method of forming an in situ oil shale retort in a retort site within a subterranean formation containing oil shale, such an in situ oil shale retort containing a fragmented permeable mass of formation particles containing oil shale and having a top boundary, side boundaries, and a bottom boundary of unfragmented formation, the method comprising the steps of:

(a) excavating formation to form at least one void in the subterranean formation, leaving zones of unfragmented formation adjacent such a void within the boundaries of the retort site, such a zone of unfragmented formation having a free face adjacent the void;

(b) forming at least one main blasthole in such a zone of unfragmented formation;

(c) placing at least one explosive charge shaped for forming a high velocity gas jet into such a main blasthole with the axis of the gas jet extending transverse to the main blasthole;

(d) detonating such a shaped charge for forming an auxiliary blasthole in unfragmented formation adjacent a side wall of the main blasthole, wherein such an auxiliary blasthole is in communication with the main blasthole and extends away from the main blasthole;

(e) placing explosive into the main blasthole and into such an auxiliary blasthole; and (f) detonating the explosive for explosively expanding formation towards such a free face for forming the fragmented permeable mass of formation particles in the in situ oil shale retort.

19. The method according to claim 18 comprising forming an array of main blastholes in such a zone of unfragmented formation wherein the main blastholes are perpendicular to such a free face.

20. The method according to claim 18 comprising forming such an auxiliary blasthole wherein the axis of the auxiliary blasthole is at an acute angle with the direction of propagation of a detonation wave in such a main blasthole.

21. The method according to claim 18 comprising forming such an auxiliary blasthole wherein the auxiliary blasthole extends in a direction parallel to such a side boundary of the retort.

22. The method according to claim 18 including placing a free running explosive into such a main blasthole and into such an auxiliary blasthole.

23. The method according to claim 18 comprising forming such an auxiliary blasthole wherein the length of the auxiliary blasthole is very much greater than the diameter of such an auxiliary blasthole.

24. The method according to claim 18 comprising forming such an auxiliary blasthole at about the location of initiation of detonation of explosive in such a main blasthole.

25. The method according to claim 18 comprising forming a plurality of auxiliary blastholes from such a main blasthole wherein such auxiliary blastholes are formed at a plurality of locations and radial directions along the length of the main blasthole.

26. The method according to claim 18 comprising the additional step of placing a booster at the opening of such an auxiliary blasthole.

27. The method according to claim 18 wherein such a shaped charge forms a high velocity gas and fragment jet.

28. The subterranean formation containing oil shale in an intermediate stage of preparation of an in situ oil shale retort having a top boundary, side boundaries, and a bottom boundary of unfragmented formation comprising:

(a) at least one void in the subterranean formation;
(b) at least one zone of unfragmented formation adjacent such a void, such a zone of unfragmented formation having a free face adjoining the void;
(c) an array of main columnar explosive charges in such a zone of unfragmented formation;
(d) at least one auxiliary columnar explosive charge in communication with such a main columnar explosive charge, wherein such an auxiliary columnar explosive charge is in communication with a main columnar explosive charge adjacent a side boundary of such an in situ oil shale retort being formed and has an axis parallel to such adjacent side boundary; and
(e) means for detonating such explosive charges for explosively expanding unfragmented formation toward such a free face.

29. The subterranean formation of claim 28 wherein the array of main columnar explosive charges is generally parallel to such a free face.

30. The subterranean formation of claim 28 wherein the axis of such an auxiliary columnar explosive charge is at an acute angle with the axis of such a main columnar explosive charge in the direction away from the means for detonating.

31. The subterranean formation of claim 28 wherein the explosive charges comprise a free running explosive.

32. The subterranean formation of claim 28 wherein the length of such an auxiliary columnar explosive charge is very much greater than the diameter of said auxiliary columnar explosive charge.

33. The subterranean formation of claim 28 wherein the means for detonating is located at the base of such an auxiliary columnar explosive charge.

34. The subterranean formation of claim 28 further comprising a booster at the base of such an auxiliary columnar explosive charge.

35. The subterranean formation of claim 28 wherein a plurality of auxiliary columnar explosive charges are located along the length of such a main columnar explosive charge.

36. The subterranean formation of claim 28 wherein such a zone of unfragmented formation adjacent such a void has a substantially horizontal free face adjoining the void, and wherein the array of a main columnar explosive charge comprises vertically extending columnar explosive charges.

37. A method of forming an in situ oil shale retort in a retort site within a subterranean formation containing oil shale, such as in situ oil shale retort containing a fragmented permeable mass of formation particles containing oil shale and having a top boundary, side boundaries, and a bottom boundary of unfragmented formation, the method comprising the steps of:

(a) excavating formation to form at least one void in the subterranean formation, leaving zones of unfragmented formation above and below such a void, such a zone of unfragmented formation having a substantially horizontal free face adjoining the void;
(b) forming an array of vertically extending columnar explosive charges in such a zone of unfragmented formation, such an array generally parallel to the substantially horizontal free face;
(c) forming at least one laterally extending columnar explosive charge in communication with such a vertically extending columnar explosive charge, and extending laterally from such a vertically extending columnar explosive charge; and
(d) detonating such explosive charges for explosively expanding formation towards such a horizontal free face for forming a fragmented permeable mass of formation particles in the in situ oil shale retort.

38. The method according to claim 37 comprising the step of forming at least one laterally extending columnar explosive charge in communication with such a vertically extending columnar explosive charge adjacent a side boundary of the retort, wherein the laterally extending columnar explosive charge extends in a direction parallel to such a side boundary of the retort.

39. The method according to claim 37 comprising forming a plurality of laterally extending columnar explosive charges wherein such laterally extending columnar explosive charges are formed along the length of such a vertically extending columnar explosive charge.

40. A method according to claim 37 comprising forming at least a portion of such laterally extending columnar explosive charges at about the location of initiation of such a vertically extending columnar explosive charge.

41. The method according to claim 37 comprising the step of placing a booster at the base of at least a portion of such laterally extending columnar explosive charges.

42. The method according to claim 37 comprising forming such a laterally extending columnar explosive charge, wherein the length of the laterally extending columnar explosive charge is very much greater than the diameter of said laterally extending columnar explosive charge.

* * * * *

UNITED STATES PATENT AND TRADEMARK OFFICE

CERTIFICATE OF CORRECTION

PATENT NO. : 4,281,878

DATED : Aug. 4, 1981

INVENTOR(S) : Thomas E. Ricketts

It is certified that error appears in the above—identified patent and that said Letters Patent is hereby corrected as shown below:

Please add the following language as the first paragraph under the heading "Background of the Invention".

--The Government has rights in this invention pursuant to Contract No. DE-FC20-78-LC10036 (formerly EF-77-A-04-3873) awarded by the U.S. Department of Energy.--

Signed and Sealed this

Tenth Day of July 1984

[SEAL]

*Attest:*

GERALD J. MOSSINGHOFF

*Attesting Officer*

*Commissioner of Patents and Trademarks*